United States Patent [19]

Egly

[11] 3,946,534

[45] Mar. 30, 1976

[54] PROCESS OF BLANKETING WITH INERT GAS

[75] Inventor: Richard S. Egly, West Terre Haute, Ind.

[73] Assignee: Commercial Solvents Corporation, Terre Haute, Ind.

[22] Filed: Jan. 16, 1975

[21] Appl. No.: 541,548

[52] U.S. Cl. ..... 53/22 R; 53/112 R; 55/38; 55/53; 141/11

[51] Int. Cl.[2] ..... B65B 31/06; B65B 31/00

[58] Field of Search ..... 53/7, 22 R, 112 R, 79, 53/88; 141/11, 70, 92; 55/38, 52, 53

[56] References Cited

UNITED STATES PATENTS

| | | | |
|---|---|---|---|
| 1,742,206 | 1/1930 | Glekler | 141/92 |
| 2,174,745 | 10/1939 | Hoffman et al. | 53/22 R |
| 2,684,806 | 7/1954 | McBean | 53/22 R |
| 2,718,275 | 9/1955 | Banks | 55/38 |
| 2,733,850 | 2/1956 | Welty et al. | 141/92 X |
| 3,012,591 | 12/1961 | McCormack et al. | 53/7 X |
| 3,212,537 | 10/1965 | Hinxlage et al. | 53/22 R X |
| 3,531,908 | 10/1970 | Rausing et al. | 141/92 X |
| 3,732,668 | 5/1973 | Nichols | 55/53 X |
| 3,804,133 | 4/1974 | Copping | 53/7 X |

*Primary Examiner*—Travis S. McGehee
*Assistant Examiner*—Horace M. Culver
*Attorney, Agent, or Firm*—Robert H. Dewey; Howard E. Post

[57] ABSTRACT

A process for substantially eliminating dissolved oxygen from a liquid and from a shipping container therefor by purging the container with inert gas, pressurizing with the gas to about at least 10 psig and then releasing the pressure, repeating the pressurizing and releasing steps for a plurality of times, introducing the liquid while maintaining flow of inert gas until the container is filled, and closing said container securely.

9 Claims, 1 Drawing Figure

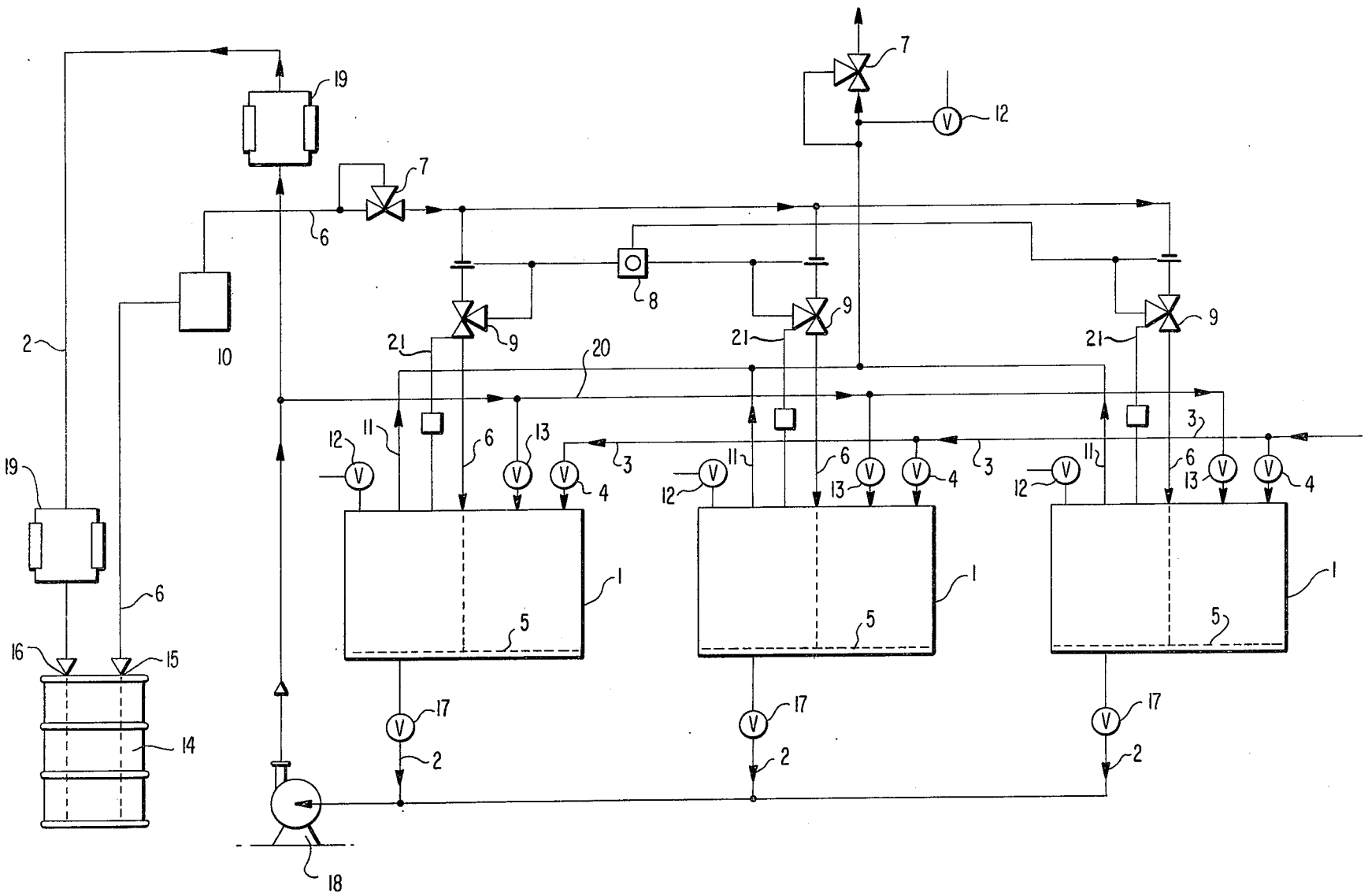
1
2
3
4
5
6
7
8
9
10
11
12
13
14
15
16
17
18
19
20
21

PROCESS OF BLANKETING WITH INERT GAS

BACKGROUND OF THE INVENTION

This application relates to a method of blanketing a container of liquid with an inert gas. In a particular aspect this application relates to a method for displacing atmospheric oxygen with an inert gas from the head-space of a container of a liquid.

Many liquids are reactive with oxygen. Such liquids include solutions of salts of anions in a reduced state, solutions of cationic salts and acids in a reduced state, ethers, highly flammable liquids the vapors of which form explosive mixtures with air over a broad range of concentrations, and liquids with low ignition temperatures.

One such liquid is nitromethane. It is known that, when nitromethane is confined in heavy-walled containers, it can be detonated by severe shock. It is also known that when the head space of the container is filled with nitrogen instead of air a significantly stronger shock is required for detonation. It is believed that the following sequence of events occurs in the presence of air: the vapors of nitromethane mixed with air are compressed by the shock under near-adiabatic conditions, thus raising the temperature of the vapor mixture to the ignition point where it burns, thereby increasing the pressure and temperature whereupon the liquid nitromethane begins to burn as a monopropellant and as the pressure and temperature rise, the entire body of the liquid detonates. In the absence of oxygen, there is no flammable vapor mixture to ignite and, for detonation to occur, the shock must be severe enough to raise the temperature of the vapors and/or liquid nitromethane to self-ignition temperatures. Hence, displacing air from such a container with an inert gas such as nitrogen, constitutes a safety measure.

The pressures required to achieve detonation are far greater than can be withstood by the usual shipping container, i.e. a Department of Transportation specification 17E drum. Repeated attempts have been made to detonate nitromethane in 17E drums using a variety of methods of delivering severe shock, but all that occurred was mechanical failure of the drum. It, therefore, seems that shipment of nitromethane in such containers, even with air in the head space, is without hazard due to shock. Nevertheless, the added margin of safety provided by displacing the oxygen, i.e. to less than 1% by vol., in the head space is deemed worthwhile and such a practice has been followed for a number of years.

Previously, the method employed was to fill the drum to overflowing thereby eliminating all head space, then using nitrogen under pressure, to displace sufficient liquid to provide the desired head space. This procedure apparently gave good results with little difficulty when the oxygen was determined soon after filling. However after only 24 hours of storage, it was often found that the oxygen content had risen well above 1%. In fact concentrations with 8–10% were common. Even after reblanketing with nitrogen for 2 minutes, as much as 7% or more oxygen could be determined after 24 hours. The source of the oxygen was traced to oxygen dissolved in the nitromethane in the distillation columns and in the check tank prior to delivery to storage.

Accordingly, an improved method is needed for effecting oxygen removal and nitrogen blanketing of containers filled with nitromethane or other liquids to be protected from oxygen.

SUMMARY OF THE INVENTION

It is an object of this invention to provide a method of blanketing a container of liquid with an inert gas.

It is another object of this invention to provide a method for displacing atmospheric oxygen with an inert gas from a container of a liquid.

It is yet another object of this invention to provide a method for substantially eliminating dissolved oxygen from a liquid prior to storage and maintaining it substantially oxygen-free until it has been delivered into a shipping container which is also substantially oxygen-free and the container is sealed.

Other objects of this invention will be apparent to those skilled in the art from disclosure herein.

The process of the present invention is directed to a method for substantially eliminating dissolved oxygen from a liquid and from a shipping container therefor comprising the steps of a. purging said shipping container with said inert gas at the bottom of said container, pressurizing with said gas to about at least 10 psig, then releasing said pressure,
b. repeating said pressurizing and releasing steps for a plurality of times,
c. introducing said liquid at bottom of said container while maintaining flow of inert gas at bottom of said container until said is filled, and
d. sealing said container.

DETAILED DISCUSSION

The present invention contemplates delivery of a liquid into a shipping container and sealing same using a process which limits the oxygen concentration to less than 1% in the vapors occupying the head space of the container. In a larger embodiment, the present invention embraces the process of substantially freeing the liquid from oxygen, i.e. to less than 1% by volume, prior to storage, and maintaining it substantially free from oxygen until it has been delivered to the shipping container and it is sealed. Such a process involves the steps of a. purging a storage tank for storing the liquid with an inert gas to provide an atmosphere containing less than 1% by volume of oxygen,
b. purging the liquid with the inert gas,
c. filling the storage tank with the liquid while maintaining an inert gas atmosphere,
d. pressurizing the tank filled with the liquid to from about 4 to about 7 psig,
e. purging the shipping container with an inert gas by introducing the inert gas at the bottom of the container, pressurizing with the gas to about at least 10 psig, then releasing the pressure,
f. repeating the pressurizing and releasing steps for a plurality of times,
g. introducing the liquid at the bottom of the container while maintaining flow of inert gas at the bottom of the container until it is filled, and
h. sealing the container.

The process will be discussed in detail with particular reference to nitromethane as the liquid and nitrogen as the inert gas. This is for convenience only, however, as it is not intended that the invention be limited thereby. The invention can be practiced with any liquid and the inert gas can be any suitable gas as set forth below.

Nitromethane is a product of the vapor phase nitration of propane. It is separated from the products of nitration and purified by distillation. As the product is collected at the still head, it is sent to a check tank for weighing, then is periodically delivered to a storage tank, which in the practice of this invention, is maintained under an atmosphere of nitrogen at a pressure of 4–7 psig.

The drawing shows the general piping and storage layout.

In the practice of this invention three storage tanks 1 are employed: one is being drawn on for drumming, through line 2; one is filled and held in reserve; and the third is being filled from line 3 through block valves 4 from the check tank (not shown). An empty tank ready for filling is purged with nitrogen through sparger 5 supplied with nitrogen through line 6 and accessories, e.g. pressure-indicating controller 7, recorder controller 8, and flow-indicating controllers 9, from a nitrogen source 10. Exit gases and pressure equalization on the tanks is effected by lines 11 and 21 and suitable accessories, e.g. a pressure-indicating controller 7, relief valves 12, and block valves 13.

When the tank is satisfactorily purged, i.e. to an atmosphere containing less than 1% by volume of oxygen, nitromethane is introduced and is maintained under 4–7 psig of nitrogen at all times. The nitromethane is then purged by passing nitrogen through it at 4–7 psig until it is substantially oxygen-free, i.e. to less than 0.025% by weight.

For drumming nitromethane under a nitrogen atmosphere, a drum 14 with a ¾ inch bung 15 and a 2-inch bung 16 in the top is used. In one embodiment of the invention, nitrogen inlet attached to line 6 is introduced to the bottom of the empty drum through the ¾ inch bung and the 2-inch bung is closed. The drum is pressurized to 10 psig with nitrogen, and the released to atmospheric. It is repressurized and released a plurality of times, e.g. 2 or 3 or more; then, with continuous nitrogen flow nitromethane (which is saturated with nitrogen at 4–7 psig) is introduced at the bottom of the drum through the 2-inch bung 16 and an extension of line 2. Nitromethane is withdrawn from the tank through line 2 and valve 17 by means of pump 18 and is delivered to the drumming operation through detonation traps 19. When the drum is filled to a predetermined weight, line 2 is withdrawn, and the bungs are closed as rapidly as possible.

In a second, preferred embodiment, bung 15 is kept closed and through bung 16 is introduced a lance which is adapted to simultaneously introducing nitrogen and nitromethane and which is adapted to seal bung 16 when placed therein. With the lance in place, the drum is pressurized to 10 psig with nitrogen, released to atmospheric pressure, and again pressurized a plurality of times as previously described. Nitromethane and nitrogen are then introduced simultaneously to the bottom of the drum and as the liquid level rises, the lance is slowly withdrawn, keeping the tip below the liquid level. When the drum is filled, the lance is rapidly withdrawn and bung 16 is sealed. The oxygen content of the vapors in the head space is less than 1%.

The inert gas used in the practice of this invention is of good commercial quality. The maximum oxygen content should be 0.1%. Suitable inert gases include helium, neon, argon and, preferably, nitrogen. Carbon dioxide, methane, ethane, propane, butane and chloroflurohydrocarbons are also suitable for some liquids.

The invention will be better understood with reference to the following example. It is understood that this example is intended for illustration only, and it is not intended that the invention be limited thereby.

EXAMPLE

A supply of nitrogen 99+% was connected to the system (see 10 in the drawing). The pressure at this point was adjusted to about 250 psig. Before entering the storage tank, the pressure was reduced to approximately 25 psig. Nitrogen was flushed through the system until it was determined that the oxygen content of the effluent gases was less than 1%. The common header (12 on the drawing) was set at 4 psig and the safety release valve on each tank was set at 7 psig.

Nitromethane was then introduced into the tanks as it was accumulated from the production unit and nitrogen was sparged through it continuously until it was determined that the nitromethane was sufficiently purged of oxygen.

A 55-gallon drum was then purged with nitrogen by inserting through the larger (i.e. 2-inch) bung a lance adapted to seal the bung and to deliver either nitrogen alone or nitrogen and nitromethane simultaneously at the bottom of the drum. Nitrogen flow was started and the drum was pressurized to 10 psig. The pressure was released and the drum was pressurized and released three times more. Nitromethane and nitrogen were then introduced simultaneously through the lance which was gradually withdrawn at a rate such that the tip of the lance was maintained beneath the surface of the liquid. When the shipping weight (500 lbs.) of nitromethane had been delivered, the nitromethane flow was shut off, the lance was withdrawn as quickly as possible and the container was sealed.

The oxygen in the vapors of the head space above the liquid is less than 1% by volume and remains less than 1% during storage and shipment until the sealed bung is opened.

I claim:

1. A process for substantially eliminating oxygen from a shipping container while filling with a liquid comprising the steps of a. purging said shipping container with an inert gas by introducing said inert gas at the bottom of said container, pressurizing with said gas to about at least 10 psig, releasing said pressure, b. repeating said pressurizing and releasing steps for a plurality of times, c. introducing said liquid while maintaining flow of inert gas until said container is filled, and d. closing said container securely.

2. The process of claim 1 wherein said inert gas is selected from the group consisting of helium, neon, argon, nitrogen, carbon dioxide, methane, ethane, propane, butane and chlorofluorohydrocarbons.

3. The process of claim 2 wherein said gas is nitrogen.

4. The process of claim 3 wherein said liquid is nitromethane.

5. The process of claim 1 wherein said pressurizing and release is repeated twice.

6. The process of claim 1 wherein said pressurizing and release is repeated three times.

7. The process of claim 1 wherein said liquid and said gas are introduced at the bottom of said container.

8. The process of claim 1 wherein said gas is introduced under the top of said liquid.

9. A process for substantially eliminating dissolved oxygen from a liquid and from a shipping container therefor comprising the steps of a. purging a storage tank for storing said liquid with said inert gas to provide an atmosphere containing less than 1% oxygen, b. purging said liquid with said gas, c. filling said storage tank with said liquid while maintaining said inert gas atmosphere, d. pressurizing said tank filled with said liquid to from about 4 to about 7 psig, e. purging said shipping container with said inert gas by introducing said inert gas, pressurizing with said gas to about at least 10 psig, releasing said pressure, f. repeating said pressurizing and releasing steps for a plurality of times, g. introducing said liquid at bottom of said container while maintaining flow of inert gas until said container is filled, and h. sealing said container.

* * * * *

UNITED STATES PATENT OFFICE

CERTIFICATE OF CORRECTION

Patent No. 3,946,534 Dated March 30, 1976

Inventor(s) Richard S. Egly

It is certified that error appears in the above-identified patent and that said Letters Patent are hereby corrected as shown below:

In the Abstract, line 3, "pressuruzing" should read -- pressurizing --

Column 3, line 37, "the" should read -- then --

Signed and Sealed this

Seventeenth Day of May 1977

[SEAL]

*Attest:*

RUTH C. MASON
*Attesting Officer*

C. MARSHALL DANN
*Commissioner of Patents and Trademarks*